US008898940B1

(12) United States Patent
Hasan

(10) Patent No.: US 8,898,940 B1
(45) Date of Patent: Dec. 2, 2014

(54) HAZARDOUS-RATED EXIT SIGN AND FLOODLIGHTS

(71) Applicant: Rig-A-Lite Partnership, Ltd., Houston, TX (US)

(72) Inventor: Syed Q. Hasan, Houston, TX (US)

(73) Assignee: Rig-A-Lite Partnership, Ltd., Houston, TX (US)

( * ) Notice: Subject to any disclaimer, the term of this patent is extended or adjusted under 35 U.S.C. 154(b) by 41 days.

(21) Appl. No.: 13/893,118

(22) Filed: May 13, 2013

(51) Int. Cl.
*G09F 13/04* (2006.01)
*G09F 13/06* (2006.01)

(52) U.S. Cl.
CPC ..... *G09F 13/0413* (2013.01); *G09F 13/06* (2013.01); *G09F 2013/0445* (2013.01)
USPC ..... 40/570; 40/544

(58) Field of Classification Search
USPC ..... 40/570, 553
See application file for complete search history.

(56) References Cited

U.S. PATENT DOCUMENTS 4,201,005 A * 5/1980 Hunt ..... 40/570
6,606,808 B2 * 8/2003 Katz ..... 40/570
7,287,347 B2 10/2007 Hasan

* cited by examiner

*Primary Examiner* — Joanne Silbermann
(74) *Attorney, Agent, or Firm* — Gary L. Bush; Andrews Kurth LLP

(57) ABSTRACT

An exit sign includes an explosion-proof housing having a first chamber and a second chamber within the housing separated by a divider wall, a bottom plate attached to said housing and defining an interface between said housing and said bottom plate, and a window, disposed in said bottom plate, containing a clear glass or plastic window pane and located proximate to said first chamber of said housing, wherein a volume of said first chamber, a housing wall thickness surrounding said first chamber, a divider wall thickness, and a window pane thickness are arranged and designed according to an expected internal explosion pressure within said first chamber, and wherein a volume of said second chamber, a housing wall thickness surrounding said second chamber, and a divider wall thickness are arranged and designed according to an expected internal explosion pressure within said second chamber. The exit sign includes a generally planar sign panel coupled to said housing at said window, an indicium disposed on said sign panel, a plurality of light emitting diodes disposed within said second chamber of said housing and directed to shine light through said window into said sign panel, and at least one floodlight comprising one or more light emitting diodes directed to illuminate a region in proximity with said exit sign.

19 Claims, 5 Drawing Sheets

HAZARDOUS-RATED EXIT SIGN AND FLOODLIGHTS

BACKGROUND OF THE INVENTION

1. Field of the Invention

This invention relates generally to hazardous-location-rated fixtures and specifically to illuminated exit signs.

2. Description of the Prior Art

Fixtures for use within hazardous locations are well known. In the 1920s, the National Electric Code (NEC) addressed requirements for fixtures to be located in rooms or compartments in which highly flammable gases, liquids, mixtures or other substances were manufactured, used or stored. In 1931, the NEC first defined hazardous location classifications Class I for gases and vapors, Class II for dusts, and Class III/Class IV for fibers. Four years later, the NEC subdivided Class I locations into groups based on explosive pressure and flame transmission capacity. Group A includes acetylene. Group B includes hydrogen. Group C includes ethyl ether, and Group D includes gasoline, petroleum, alcohol, acetone, solvent vapors, and gases and vapors of equivalent hazard. Likewise, in 1937, the NEC defined groups for Class II with Group E including metal dusts, Group F including coal and other carbonaceous dusts, and Group G including woods, plastic, et cetera. In 1947, the NEC combined flammable fiber Classes III and IV, and it introduced the concept of divisions, where Division 1 indicates a location where ignitable concentrations (of gases, vapors or liquids for Class I and of combustible dusts for Class II) can exist all of the time or some of the time under normal operating conditions and where Division 2 indicates a location where ignitable concentrations (of gases vapors or liquids for Class I and of combustible dusts for Class II) are not likely to exist under normal operating conditions. For each class, group and division, performance and construction standards for fixtures have been established to ensure safety within the hazardous area.

Today, a worldwide industry exists for setting performance standards for devices which operate within hazardous locations and for certifying those devices which meet those standards. For example, Underwriters Laboratories (UL), National Fire Protection Association (NFPA), American National Standards Institute (ANSI), National Electrical Manufacturers Association (NEMA), Canadian Standards Association (CSA), International Electrotechnical Commission (IEC), and European Committee for Electrotechnical Standardization (CENELEC) all publish standards for equipment or fixtures to be located in various hazardous locations. In 1997, in response to recent attempts at global harmonization of the various international standards, the NEC introduced the international zone classification system for Class I as an alternative to Division 1 and Division 2 classifications, which are used only in the United States and Canada. Zone 0 indicates locations where ignitable concentrations of flammable gases, vapors, or liquids are present continuously or for long periods of time under normal operating conditions. Zone 1 indicates locations where ignitable concentrations of flammable gases, vapors or liquids are likely to exist under normal operating conditions, and Zone 2 indicates locations where ignitable concentrations of flammable gases, vapors or liquids are not likely to exist under normal operating conditions. The international zone classification system has its own group ratings to indicate the potential explosive pressure and flame transmission characteristics of the hazardous area.

Although somewhat obfuscatory, the various class/division or class/zone hazardous area classifications form a framework which can be used to summarize the accepted protection methods approved for use. For example, for areas where ignitable concentrations of flammable gases, vapors or liquids can exist all of the time or some of the time under nomial operating conditions (Class I Division 1, U.S. and Canada only), accepted protection methods for fixtures include explosion-proof construction, Type X or Y purging/pressurizing of the fixture, or using two-fault intrinsically safe circuitry. Where ignitable concentrations of flammable gases, vapors or liquids are not likely to exist under normal operating conditions (Class I Division 2, U.S. and Canada only), the accepted protection methods can be relaxed to include less rigorous standards, including nonincendive or non-sparking device construction, Type Z purging/pressurizing, and hermetically sealed construction.

The Class I international zone classification protection methods are similar, but some differences exist. For Class I Zone 0 (where ignitable concentrations of flammable gases, vapors, or liquids are present continuously or for long periods of time under normal operating conditions), only two-fault intrinsically safe circuitry is authorized; neither purging/pressurizing nor explosion-proof construction is deemed sufficient. Class I Zone 1 (where ignitable concentrations of flammable gases, vapors, or liquids are likely to exist under normal operating conditions) protection methods include encapsulation, flameproof construction, one-fault intrinsically safe circuitry, oil immersion, powder filling, and purging/pressurizing. Class I Zone 2 (where ignitable concentrations of flammable gases, vapors, or liquids are not likely to exist under normal operating conditions) protection methods include nonincendive or non-sparking construction, restricted breathing, hermetically sealed construction, energy limited circuitry, and simplified pressurization techniques.

Class II categories have similar protection methods. For Class II Division 1 areas (where ignitable concentrations of combustible dusts can exist all of the time or some of the time under normal operating conditions), protection methods include dust ignition-proof construction, intrinsically safe circuitry, and pressurization. Class II Division 2 (where ignitable concentrations of combustible dusts are not likely to exist under normal operating conditions) protection methods include dust-tight construction and nonincendive or non-sparking construction.

Generally, the more stringent protection methods authorized for higher (more hazardous) area classifications can be used in areas characterized by lower (less hazardous) classifications. For example, in addition to the nonincendive or non-sparking construction, restricted breathing, hermetically sealed construction, energy limited circuitry, or simplified pressurization techniques authorized for Class I Zone 2 areas mentioned above, any protection method authorized for Class I Zone 0, Class I Zone 1, or Class I Division 1 is suitable for use in Class I Zone 2 areas.

Explosion-proof exit signs which are suitable for use in Class I Division 1 Groups C and D, Class 1 Zone 0 Groups C and D, Class II Division 1 Groups E, F, and G, and Class III areas, among others, are known in the art. They typically include two incandescent lamps housed in a casing designed to withstand the pressure of explosions generated by an internal arc without propagating the explosion into the surrounding hazardous atmosphere. Inevitably, the incandescent lamps are subject to burn out, requiring maintenance and upkeep. A relamping tool is generally required to replace the light bulbs, and should the maintenance person fail to properly seal the exit sign after lamp replacement, explosion-proof integrity may be compromised.

Further, the explosion-proof exit signs known in the art do not have an integral battery back-up or other source of redundant power to keep the signs illuminated during power failures. Thus, it is generally required to wire the exit signs on a dedicated circuit which is equipped with an external redundant power source such as an emergency generator. The separate circuit(s) required for exit signs results in increased facility construction costs. Still further, explosion-proof signs known in the art do not provide adequate or additional illumination of a point of exit from a building, which may impede safe and fast egress from a building in the event of an emergency or power outage.

It is advantageous to have an explosion-proof exit sign which does not require periodic lamp replacement and which contains an integral battery back-up, and which illuminates an area for safe egress from a building.

3. Identification of the Objects of the Invention

An object of the invention is to provide an exit sign suitable for use in areas with a hazardous or potentially hazardous atmosphere which uses a long-life low-powered non-incandescent light source for maximum reliability.

Another object of the invention is to provide an exit sign suitable for use in areas with a hazardous or potentially hazardous atmosphere which eliminates the requirement for external redundant power by including an internal rechargeable battery backup.

Another object of the invention is to provide a method for aiding emergency egress from an area with a hazardous or potentially hazardous atmosphere by providing a reliable exit sign.

Another object of the invention is to provide an exit sign suitable for use in illuminating an area for safe egress from a building in the event of an emergency of power outage in the building.

SUMMARY OF THE INVENTION

In one aspects, embodiments disclosed herein relate to an exit sign comprising an explosion-proof housing, said housing comprising a first chamber and a second chamber within the housing separated by a divider wall; a front cover attached to said housing and defining an interface between said housing and said front cover, said interface defining a vent path for gases within said housing to exit said housing, and said front cover and said housing defining a heat sink for cooling said gases exiting said housing through said vent path; a bottom plate attached to said housing and defining an interface between said housing and said bottom plate, said interface defining a vent path for gases within said housing to exit said housing, and said bottom plate and said housing defining a heat sink for cooling said gases exiting said housing through said vent path; a window, disposed in said bottom plate, containing a clear glass or plastic window pane and located proximate to said first chamber of said housing, wherein a volume of said first chamber, a housing wall thickness surrounding said first chamber, a divider wall thickness, and a window pane thickness are arranged and designed according to an expected internal explosion pressure within said first chamber; wherein a volume of said second chamber, a housing wall thickness surrounding said second chamber, and a divider wall thickness are arranged and designed according to an expected internal explosion pressure within said second chamber; a generally planar sign panel having a first edge which is coupled to said housing at said window; an indicium disposed on said sign panel; a plurality of light emitting diodes disposed within said second chamber of said housing and directed to shine light through said window into said sign panel; and at least one floodlight comprising one or more light emitting diodes directed to illuminate a region in proximity with said exit sign.

In other aspects, embodiments disclosed herein relate to an exit sign comprising: an explosion-proof housing, said housing comprising a first chamber and a second chamber within the housing separated by a divider wall; a front cover attached to said housing and defining an interface between said housing and said front cover, said interface defining a vent path for gases within said housing to exit said housing, and said front cover and said housing defining a heat sink for cooling said gases exiting said housing through said vent path; a bottom plate attached to said housing and defining an interface between said housing and said bottom plate, said interface defining a vent path for gases within said housing to exit said housing, and said bottom plate and said housing defining a heat sink for cooling said gases exiting said housing through said vent path; a window disposed in said bottom plate containing a clear glass or plastic window pane and located proximate to said first chamber of said housing; a generally planar sign panel having a first edge which is coupled to said housing at said window; an indicium disposed on said sign panel; a plurality of light emitting diodes disposed within said second chamber of said housing and directed to shine light through said window into said sign panel; at least one floodlight arranged and designed to illuminate an area, said floodlight comprising: a light source disposed on a bowl-shaped light fixture, said light fixture disposed within an explosion-proof housing; and a socket having a bowl-like depression, and disposed within said housing, said bowl-shaped light fixture arranged and designed to correspond with a bowl-like depression of said socket, wherein said bowl-shaped light fixture is adjustable and moves relative to said socket to adjust a direction of lighting from said one or more light emitting diodes; one or more rechargeable batteries disposed within said housing and operatively coupled to said light emitting diodes.

In yet other aspects, embodiments disclosed herein relate to a method of aiding emergency egress from an area with a hazardous or potentially hazardous atmosphere comprising the steps of: providing a sign panel having at least one face characterized by an indicium directing a viewer to a location for egress, illuminating said sign panel by a plurality of light emitting diodes, housing said plurality of light emitting diodes in an explosion-proof housing, providing one or more floodlights having one or more light emitting diodes illuminating an area proximate to said sign panel, adjusting a focus of said one or more light emitting diodes of said floodlights in horizontal and vertical directions, housing said light emitting diodes in an explosion-proof housing, allowing a first gas, vapor or dust disposed within said housing and to ignite or explode without deforming or rupturing said housings, and cooling exhaust exiting said housings from said ignition or explosion within said housings to a temperature below a lowest auto-ignition temperature of a second gas, vapor, or dust surrounding said housings.

BRIEF DESCRIPTION OF THE DRAWINGS

The invention is illustrated in the accompanying drawings wherein.

DESCRIPTION OF EMBODIMENTS OF THE INVENTION

Figure 1A:
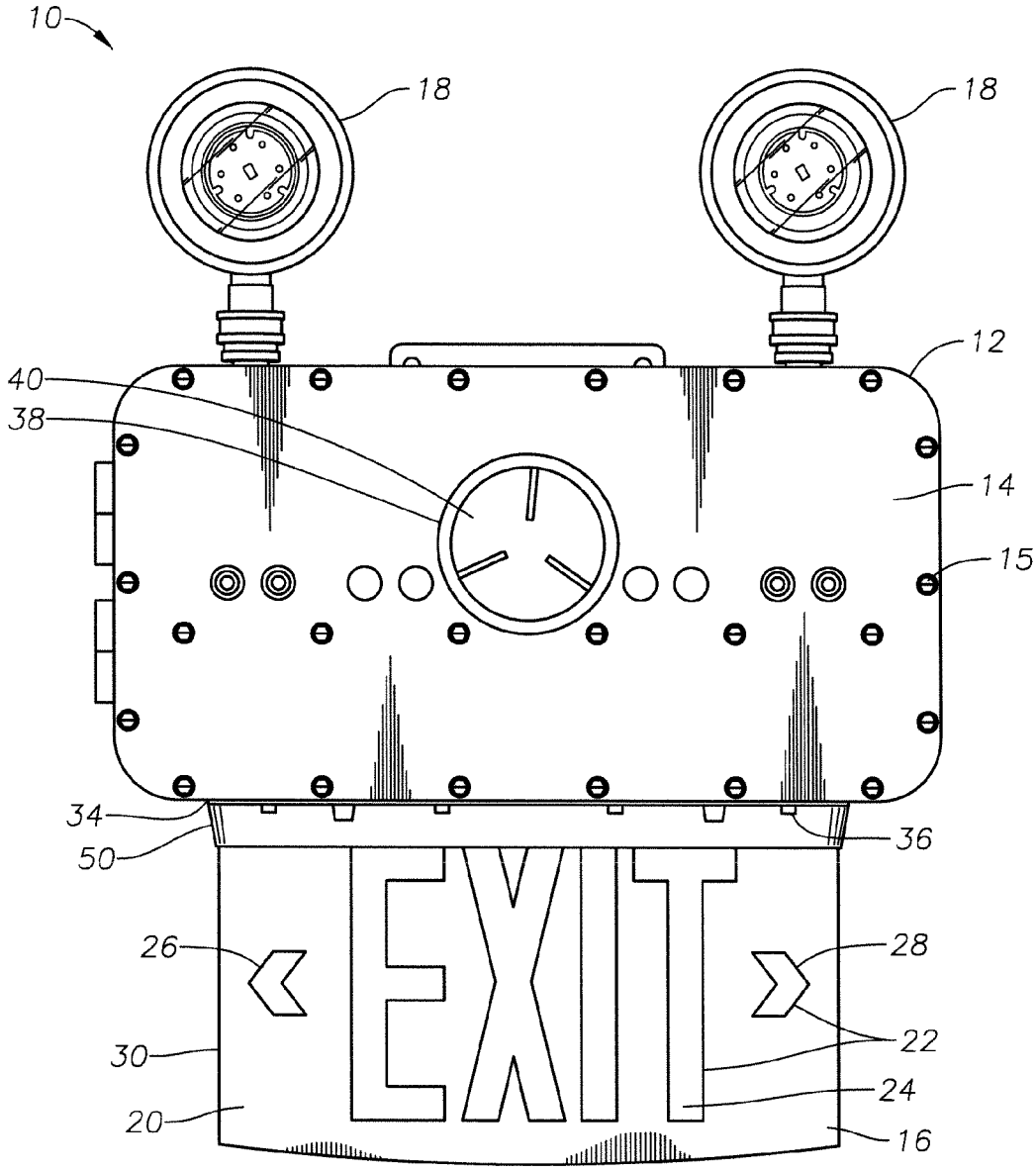
FIG. 1A shows a front view of the exit sign assembly.

The aspects, features, and advantages of the invention mentioned above are described in more detail by reference to the drawings, wherein like reference numerals represent like elements.

Figure 1B:
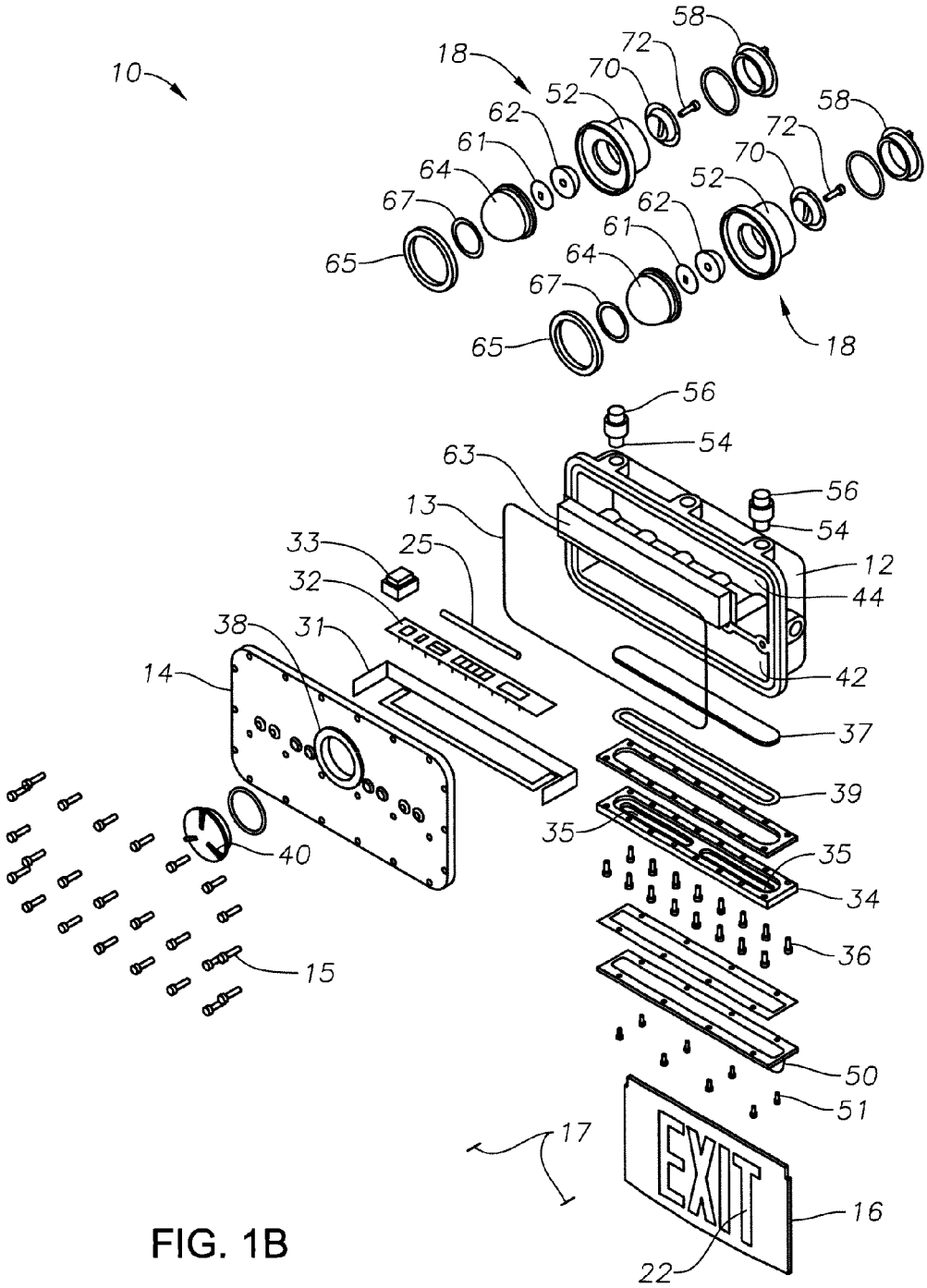
FIG. 1B shows an exploded view of the exit sign assembly.
Figure 2:
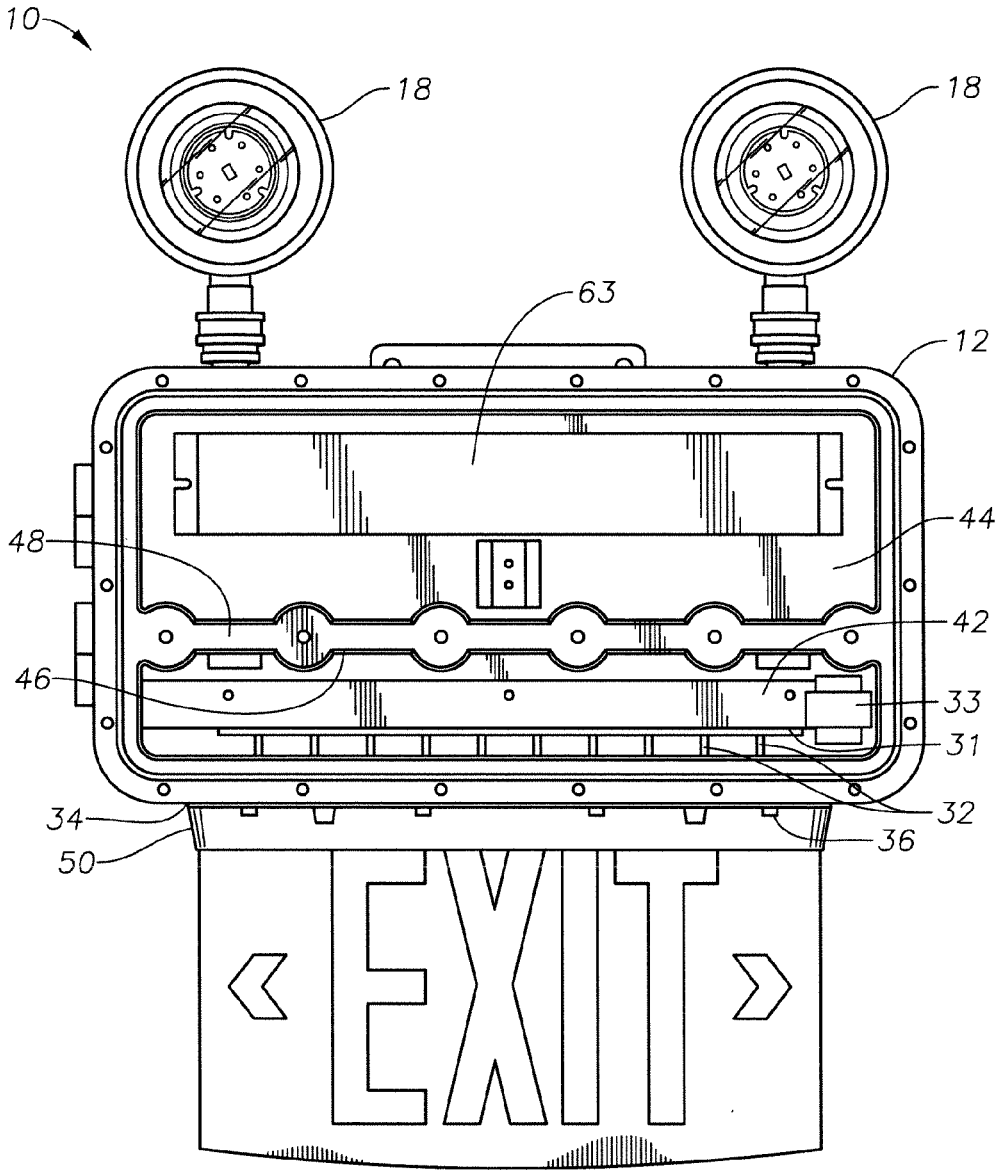
FIG. 2 shows a front view of the exit sign with a front cover removed.

Referring to FIGS. 1A, 1B and 2, an exit sign 10 suitable for use in locations deemed hazardous due to the presence or potential presence of flammable vapors or gases or combustible dusts in accordance with one or more embodiments of the present disclosure is shown. Exit sign 10 may be designed and arranged to be certified for use in NEC Class I Division 1 and 2, Groups B, C and D, Class I Zone 1 Group IIB, and Class II Division 1 Groups E, F and G. In addition, exit sign 10 may also be certified for use in Class I Zones 0, 1 and 2 Groups IIA, JIB plus hydrogen, and TIC areas. Still further, exit sign 10 may also be certified for use in Class III areas. Exit sign 10 preferably complies with UL Standard 844. UL Standards 844, 1604 and 2279 are incorporated herein by reference. The exit sign 10 includes an explosion-proof housing 12 with a front cover 14 and gasket 13 attached onto a front surface of the housing 12 by screws 15, and a sign panel 16 attached to a bottom of the housing 12 having generally planar front and back surfaces. Exit sign 10 also includes one or more floodlights 18 attached to a top portion of the explosion-proof housing 12. While two floodlights 18 are shown in FIG. 1, it will be understood by one of ordinary skill in the art that a single floodlight only may be installed on the housing 12. The floodlights 18 are arranged and designed to illuminate a room or confined space in the event of a power outage in a building or area in which the exit sign 10 is located. In other words, the floodlights 18 are powered on in the absence of electricity or power in the building to provide lighting for safe and efficient egress from the building or area.

If the exit sign 10 is arranged for parallel mounting to a wall, the sign panel 16 typically has only one face 20 which is disposed on the front planar surface of sign panel 16 which faces away from the wall so as to be in plain view. Face 20 preferably includes one or more emergency indicia 22, such as a word 24, e.g., "EXIT," "SORTIE," "SALIDA," or similar word in any other language or symbol. Preferably, word 24 uses six inch letters with a ¾ inch stroke and meets appropriate safety standards, e.g., NFPA Life Safety Code No. 101. Indicia 22 may also include an optional left arrowhead 26, right arrowhead 28, or both left and right arrowheads to indicate one or more directions. Alternatively, if the exit sign 10 is arranged for transverse mounting to a wall or for pendant mounting from a ceiling, both the front and back planar surfaces of sign panel 16 may have appropriate indicia 22 thereon. For example, if the front planar surface includes a right arrowhead 28, the back planar surface might include a left arrowhead 26.

The sign panel 16 may include one or more transparent or translucent sheets 30 which are edge lit from a printed circuit board (PCB) 32 containing a number of long life light emitting diodes (LEDs) contained within the housing 12. Preferred sheet material includes acrylic, Plexiglas™ or other suitable thermoplastics, for example. Indicia are preferably formed on a sheet 30 by relief, etching, opaque masks, or similar method. The LEDs may be colored to further contrast the indicia 22 from the background of front and back planar surfaces. Additionally or alternatively, the relief, etching or opaque masks may be colored for a similar effect, with the advantage of indicia contrast even when the exit sign 10 is not illuminated. Common sign panel 16 schemes include red indicia 22 against a white background and green indicia 22 against a clear background, but other schemes, including reverse contrast, may be used. For double-faced exit signs, sign panel 16 may include an opaque or mirrored separator (not shown) sandwiched between two clear edge-lit thermoplastic sheets 30 to prevent a user from viewing the indicia 22 of the obverse face through the sign panel 16. The mirrored separator also enhances the aesthetic appearance of the exit sign 10.

The explosion-proof housing 12 has a bottom plate 34 which mounts to the housing 12 using a number of screws 36. Bottom plate 34 preferably has holes or slots to form one or more windows 35 to allow light from LEDs on the PCB 32, located within the housing 12, to pass through the bottom plate 34. An upper surface of bottom plate 34 may include a recess for receiving a clear glass or plastic window pane 37 and a gasket 39. The housing 12 may include one or more threaded access ports 38 with complementary plugs 40.

Thus, the housing 12, front cover 14, screws 15, bottom plate 34 (including window pane and gasket), plug 40, and screws 36 are assembled to form an enclosure which must be capable of withstanding an explosion of a specified gas or vapor within the enclosure. The ability of housing 12 to withstand an internal explosion without rupturing or being permanently deformed depends upon the strength of the various enclosure materials and the overall strength and holding power of the securement means, i.e., the screws 15 and 36. The strength of the housing 12 is affected in part by the design of and the housing 12 and bottom plate 34 (shapes, casting/molding design, alloy choices, thicknesses, et cetera). Housing 12 and bottom plate 34 may be manufactured from copper-free aluminum alloy, but other suitable materials not containing zinc or magnesium may be used. If window pane is plastic, the type of plastic used is preferably resistant to chemical atmospheres. Likewise, gasket is preferably chemically resistant. The number and type of screws 15 and 36, for securing front cover 14 and bottom plate 34, respectively, may be selected to withstand the expected explosion forces. Preferably, the housing 12 is hydrostatically tested to a pressure of at least four times the expected explosion pressure.

As shown in FIG. 2, front cover 14 (FIGS. 1A and 1B) is removed from the housing 12 revealing two chambers within the housing 12, a first chamber 42 and a second chamber 44 within housing 12. The chambers are shown being generally rectangular in shape, but it will be understood by those skilled in the art that other chamber shapes are possible. The first chamber 42 is separated from the second chamber 44 by a divider wall 46, which extends a full depth of the housing 12, and extends from end to end of the housing 12. The divider wall 46 includes an attachment surface 48 to which the front cover 14 is attached when installed onto the housing 12. Thus, the front cover 14 is attached to and sits flush with a perimeter of the housing 12 and the attachment surface 48 of the divider wall 46.

The first chamber 42 is proximate to the clear glass or plastic window pane 37 (FIG. 1B) in the bottom plate 34 and through which the LEDs on the PCB 32 illuminates the exit sign 16. The first chamber 42 may be arranged and designed to have a specified volume, which in turn limits the amount of gas or vapor that may fill said first chamber 42 and pressure that may be reached within the first chamber 42, such that any explosion of a specific vapor or gas that occurs in the first chamber 42 is reduced in magnitude and will not compromise or break the clear glass or plastic window pane in the bottom plate 34. A volume of the first chamber 42 and thickness of walls of the first chamber 42 and window pane 37 are arranged and designed according to an expected internal explosion pressure within the first chamber 42. As an example, expected internal explosion pressure within the first chamber 42 may be at least about 200 psi, 300 psi, or 400 psi up to about 500 psi, 600 psi, or 700 psi. Similarly, a volume of the second chamber 44 and thickness of walls of the second chamber 44 are arranged and designed according to an expected internal explosion pressure within the second chamber 44. As an example, expected internal explosion pressure within the second chamber 44 may be at least about 400 psi, 500 psi, or 600 psi, up to about 700 psi, 800 psi, or 900 psi. Thus, the effectiveness or ability of the housing 12 to contain explosions within is not compromised.

Additionally, housing 12 must be capable of preventing the ignition of gas or vapor surrounding the enclosure due to sparks, flashes or an explosion of the gas or vapor within the enclosure. The ability of an enclosure to prevent ignition of a specified gas or vapor surrounding the enclosure is dependent on the ability of any potential flame path from the interior to the exterior of the enclosure to prevent the escape of any flames, sparks or hot particles capable of ignition and to sufficiently cool the vented material and gases. An upper surface of bottom plate 34 has a mating surface which matches a complementary mating surface of a bottom surface of the housing 12. Mating surfaces of the housing 12 and bottom plate 34 may be carefully machined to generally form a tight metal-to-metal interface without the use of a gasket or other sealing material. Likewise, mating surfaces of the front cover 14 and housing 12 are machined to form a tight metal-to-metal interface without the use of a gasket or other sealing material.

Mating surfaces may have a minimum seal length from every interior point along the perimeter of the mating surface to the nearest exterior point. The minimum seal length provides ample heat sink surface along any flame path between the mating surfaces to sufficiently cool gases escaping through that interface to prevent ignition of gases or vapors surrounding the housing 12. The minimum seal length is dependent on the internal volumes of first chamber 42 and second chamber 44 and the intrinsic ability of the mating surfaces to act as a heat sink (e.g., thermal conductivity and the immediate thickness the heat sink surfaces) and the distance between the mating surfaces, i.e., the flatness and surface finish of metal-to-metal sealing surfaces. The metal-to-metal interface between bottom plate mating surface and housing mating surface preferably allows sufficiently rapid escape of gases from an internal explosion to prevent leakage past or rupture of gasket. Additionally, screws and plugs must have sufficient thread engagement for the land-groove clearances to act sufficiently as a heat sink to cool gases escaping housing 12 via the threads.

Further, housing 12 must be capable of operating at an external temperature that will not ignite the surrounding gas or vapor. The ability of an enclosure to prevent ignition of a specified gas or vapor surrounding the enclosure is dependent on how the heat-producing components within the enclosure affect the temperature on the external surfaces of the enclosure. The external temperatures are preferably measured and represented as a temperature code, which must be less than the lowest auto-ignition temperature of the surrounding hazardous atmosphere.

The sign panel 16 may be attached to housing 12 by a molded or cast shroud 50. Shroud 50 may screw to a bottom surface of bottom plate 34 using screws 51. Shroud 50 has an aperture which receives a top edge of sign panel 16 for abutment to the bottom surface of bottom plate 34 in alignment with the one or more windows 35 in the bottom plate 34. Thus, light from LEDs in housing 12 shines through window pane 37 and one or more windows 35 into the top edge of sign panel 16 fitted within shroud aperture to illuminate faces of the front and back planar surfaces of the sign panel 16 (and the indicia 22 thereon). Sign panel 16 is held in place in aperture by pins 17 which are transversely positioned through slots in shroud 50 and holes in sign plate 16, which are in alignment.

The PCB 32 containing LEDs is aligned with the window 35 in bottom plate 34 and the top edge of sign panel 16. PCB 32 is secured in a mounting bracket 31. A step-down transformer 33, having an input coil for connecting to line voltage and a secondary coil which powers PCB 32, is preferably included in an lower portion of housing 12, such as the first chamber 42. PCB 32 preferably contains low voltage circuitry, e.g., a rectifier, voltage regulator, protective circuit elements, et cetera, for providing normal power to the LEDs. The LEDs may be any available color or a combination of colors, but red or green are preferred. The number and type of LEDs are preferably chosen so that exit light 10 conforms with the Occupational Safety and Health Administration (OSHA) standards for exit sign illumination. The LEDs consume approximately 2-4 watts, compared to 50-120 watt consumption for a dual incandescent bulb light source. LEDs also have a significantly longer expected lifespan than incandescent bulbs, reducing the need to open housing 12 for maintenance.

Exit sign 10 includes a battery 25 and charging circuits (not shown) for LEDs on the PCB 32 when externally supplied power to exit sign 10 is absent. The battery 25 and charging circuit for the PCB 32 for the sign panel 16 may be located in first chamber 42. Preferably, the battery 25 is a sealed maintenance-free rechargeable battery, such as nickel-cadmium, lithium ion, or lead-acid types. A charging circuit may be provided (preferably included on PCB 32, but it may be located elsewhere) to intelligently maintain the battery 25 at an optimal charge and to automatically recharge battery after a discharge. A low voltage disconnect feature in charging circuit preferably prevents excessive battery discharge that can permanently damage the battery 25. The battery 25 preferably has a 90 minute or greater capacity to power LEDs on the PCB 32.

Preferably, a manually operated test switch is included in exit sign 10 to allow a user to check battery operation. Preferably, switch is magnetically or mechanically actuated through housing 12 in order to maintain the explosion-proof integrity of housing 12, but other explosion-proof switches may be used. Test switch ideally executes a diagnostic testing sequence. A health indicator may display exit sign 10 status, e.g., normal operating mode, diagnostic testing mode, emergency power operation mode, high-rate battery charging mode, battery failure, light source failure, and circuit failure. For example, health indicator may be a multi-color LED. A clear cylindrical threaded lens is preferably used to maintain housing 12 explosion-proof integrity while allowing health indicator to be readily viewed, and a bezel may be used to provide a clean finished appearance. Diagnostic testing may be implemented using a microcomputer. A microcomputer is preferably included on PCB 32, but it may be located elsewhere. Additionally, part or all of the charging circuit may be integrated with microcomputer. The microcomputer may also perform self-diagnostic testing of exit sign 10 in addition to manually initiated testing. For example, a self-diagnostic testing procedure may be run for 5 minutes every 30 days and for 30 minutes every 6 months.

Because the arts of PCB design and manufacture, power and battery charging circuit design and manufacture, microcomputer design and programming, casting, molding, metal and plastic design, testing and fabrication, and assembly are well known in the art, they are not discussed further herein.

Figure 3A:
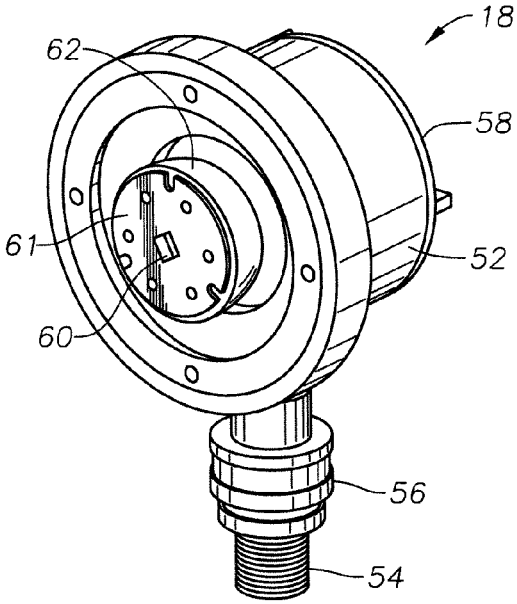
FIGS. 3A-3C show enlarged views of a floodlight.
Figure 3B:
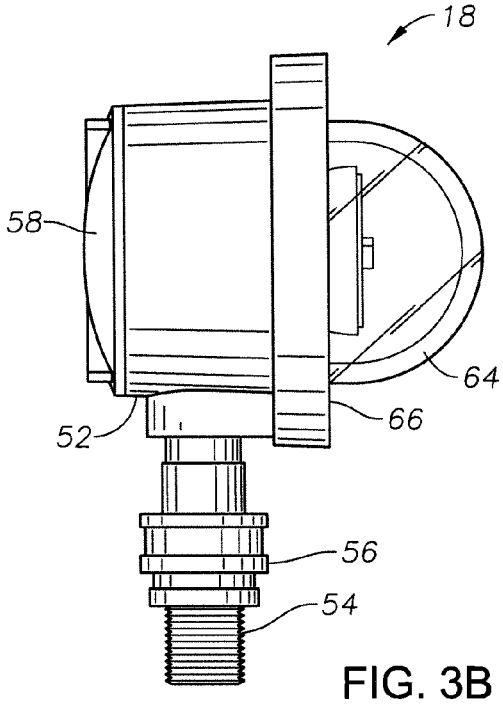
Figure 3C:
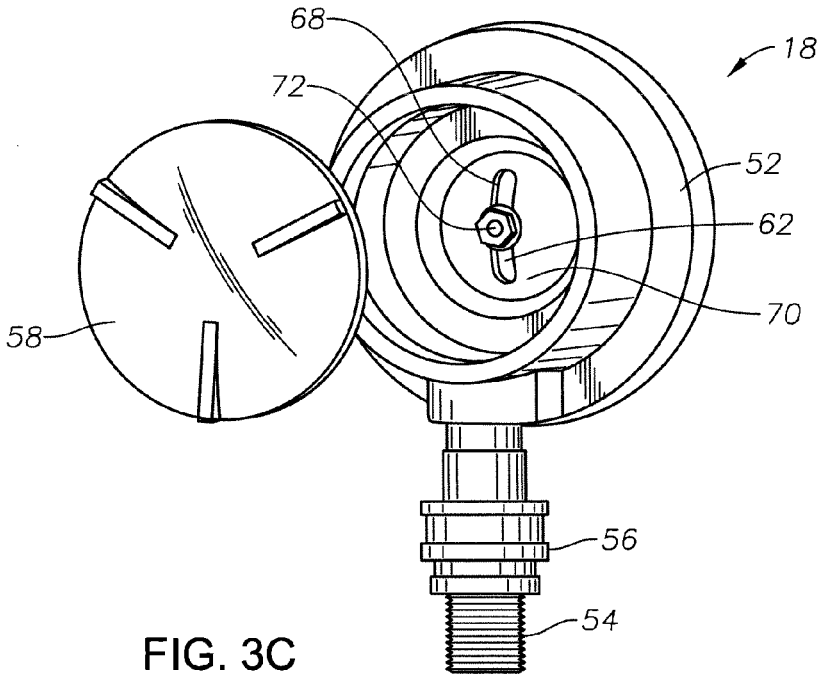

Referring now to FIGS. 3A-3C, enlarged views of a floodlight 18 in accordance with one or more embodiments of the present disclosure are shown. The floodlight 18 includes a housing 52, which may be generally cylindrically-shaped, but also may comprise other geometries. A cylindrical stem 54 extends downward from the housing 52 and is coupled to the housing 12 of the exit sign 10 to attach the floodlight 18 to the housing 12. In certain embodiments, the cylindrical stem 54 is threaded on one end to engage threads of the housing 12. In other embodiments, the cylindrical stem 54 may be attached to the housing 12 by welds, press-fit, or other known attachment means. The cylindrical stem 54 also includes a swivel 56 (also known as a "union"), which allows rotation of the housing 52 of the floodlight 18 about a vertical axis extending through the stem 54. The swivel 56 may allow 360 degree rotation of the housing 52 about the vertical axis.

A removable back cover 58 coupled to a back side of the housing 52 provides access within the housing 52. In certain embodiments, the back cover 58 is threaded into corresponding threads of the housing 52. A light source 60 held in a light fixture 62 is disposed on a front side of the housing 52. The light fixture 62 fits within the housing 52. A light cover 64 is attached to a front attachment surface 66 of the housing 52 and fits over the light source 60. Retaining rings 65 (FIG. 1B) may fit over the light cover 64 and secure the light cover 64 to the housing 52. The light cover 64 may have a thickness of at least about 0.10 inches, 0.20 inches, or 0.25 inches, and up to about 0.50 inches, 0.75 inches, or 1 inch. The light cover 64 may be glass or plastic, and is preferably a transparent or translucent material to allow light from the light source 60 to illuminate a room or area. The light cover 64 is arranged and designed to withstand any explosion of a specified gas or vapor within the housing 52 of the floodlight.

The housing 52 of the floodlight 18 is subject to the same requirements as the housing 12 of the exit sign 10. It must be capable of (i) withstanding an explosion of a specific gas or vapor within the enclosure, (ii) preventing ignition of gas or vapor surround the enclosure due to sparks, flashes or an explosion of the gas or vapor within the enclosure, and (iii) operating at an external temperature that will not ignite the surrounding gas or vapor. The strength of the housing 52 is affected in part by the design of and the housing 52 (shapes, casting/molding design, alloy choices, thicknesses, et cetera). Housing 52 may be manufactured from copper-free aluminum alloy, but other suitable materials not containing zinc or magnesium may be used. If light cover 64 is plastic, the type of plastic used is preferably resistant to chemical atmospheres. Likewise, a gasket 67 (FIG. 1B), which may be installed between light cover 64 and the front attachment face 66 of the housing 52, is preferably chemically resistant. The back cover 58, and threads for coupling the back cover 58 to the housing 52, may be selected to withstand the expected explosion forces. Preferably, the housing 52 is hydrostatically tested to a pressure of at least four times the expected explosion pressure.

Light source 60 preferably utilizes a number of long life light emitting diodes (LEDs). The LEDs are preferably mounted on a printed circuit board (PCB) 61 that fits on a front surface of the light fixture 62. A step-down transformer 63 (FIG. 2), having an input coil for connecting to line voltage and a secondary coil, battery charger and a battery which powers the PCB 61, is preferably included in an upper portion of housing 12, such as the second chamber 44. The PCB 61 preferably contains low voltage circuitry, e.g., a rectifier, voltage regulator, protective circuit elements, et cetera, for providing normal power to the LEDs. Electrical wiring (not shown) extends from the transformer 63 in the housing 12, through the cylindrical stem 54, and into the housing 52 of the floodlight 18 to reach the PCB 61 and provide power to the light source 60. The LEDs may be any available color or a combination of colors, but white is preferred. The LED light source 60 consumes approximately 2-4 watts, compared to 50-120 watt consumption for a dual incandescent bulb light source.

Further, the light fixture 62 is arranged and designed in such a way to allow for vertical (i.e., up and down) adjustment of the light source 60. As best shown in FIGS. 3A and 3C, the light fixture 62 is preferably semi-spherical or "bowl-shaped" and corresponds and engages with a fixed socket 70 having a bowl-like depression, which is disposed within the housing 52. As an example, the light fixture 62 and fixed socket 70 within the housing engage one another in a manner similar to a ball-and-socket joint (or spheroidal joint), in which the ball-shaped light fixture 62 fits into the cup-like or bowl-like depression of the fixed socket 70. The fixed socket 70 has a substantially vertical groove 68 formed there through. Further, as shown in FIG. 3C, a hollow screw 72 is inserted through the groove 68 and is threaded into the ball-shaped light fixture 62 as the head of the screw contacts a back surface of the fixed socket 70. A hollow passageway through the screw 66 acts as a passage way for electrical wiring (not shown) (running from the transformer 63 in housing 12 to housing 52) between housing 52 and light source 60 mounted on PCB 61. Alternatively, the hollow screw 72 may be arranged and designed as a hollow stud that screws into the ball-shaped light fixture 62 and onto which a separate nut may be threaded which contacts or rests on a back surface of the fixed socket 70.

Due to the corresponding ball-and-socket engagement between the light fixture 62 and fixed socket 70, the light fixture 62 is able to slide or move vertically (i.e., as limited by the direction of the groove 68) relative to the fixed socket 70. Thus, the light fixture (and accordingly the light source 60), may be adjusted vertically within the housing 52 by loosening the hollow screw 72 and moving within the groove 68 to a desired vertical position, and tightening the hollow screw 72 to maintain the light fixture 62 and light source 60 in the desired position. Accordingly, through a combination of rotating the housing 52 in a horizontal direction (i.e., left and right) using the swivel 56 in stem 54, and vertically adjusting the light fixture 62 within the housing 52 by way of the ball-and-socket light fixture 62 and fixed socket 70, the floodlight 18 may precisely illuminate a desired region or area of a room in the event of a power outage in a building in which the exit sign 10 is located.

Figure 4:
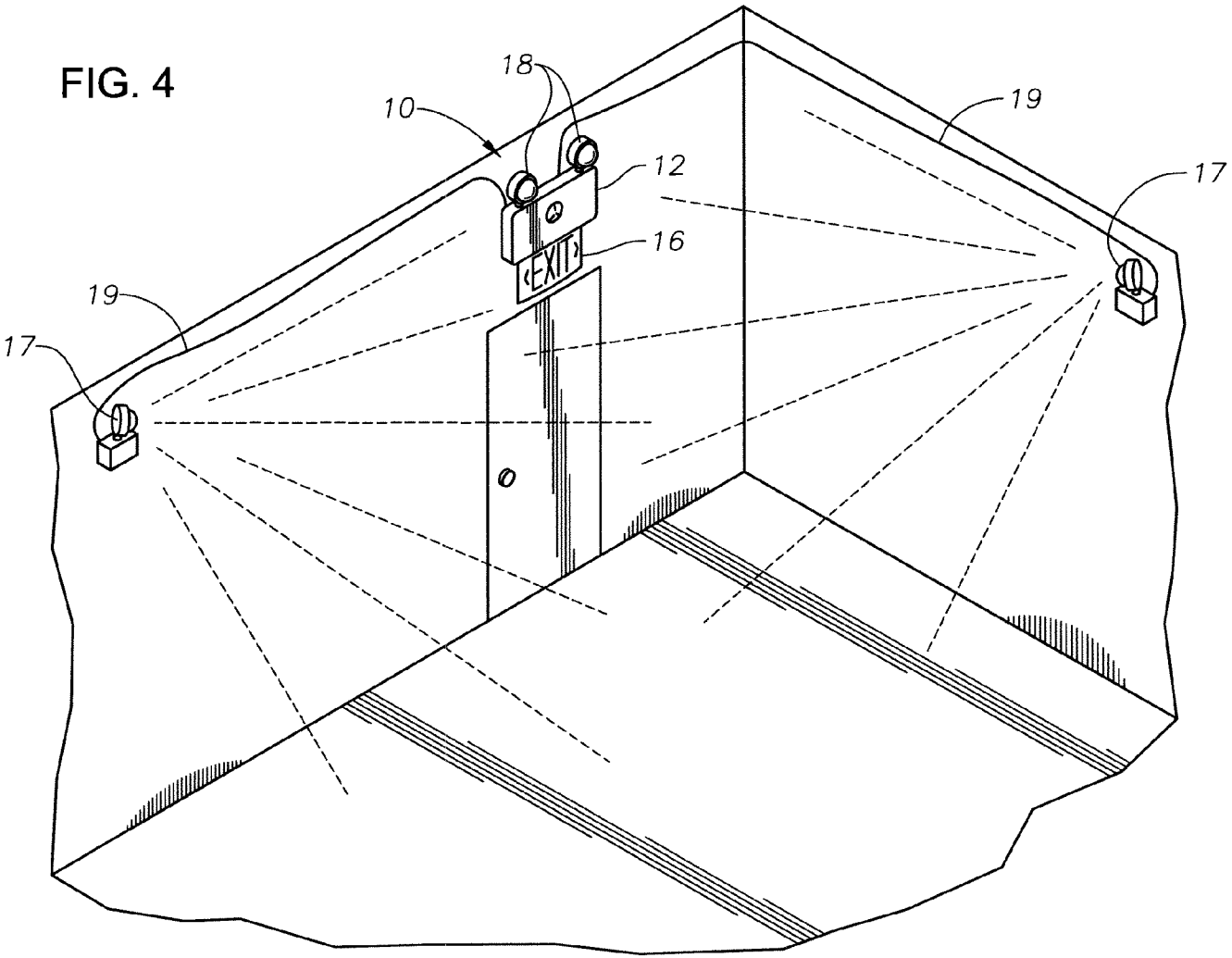
FIG. 4 shows a perspective view of a room or confined area in which an exit sign assembly and one or more floodlights are installed.

Referring now to FIG. 4, an exit sign 10 located in a room or confined space in accordance with one or more embodiments of the present disclosure is illustrated. As shown, the exit sign 10 may be installed or attached on a wall of the room or confined space such that the front surface of the sign panel 16 faces away from the wall so as to be in plain view. Alternatively, as previously mentioned, the exit sign 10 may be arranged for transverse mounting on a wall or pendent mounting from a ceiling in which both the front and back surfaces of sign panel 16 are visible.

In FIG. 4, remote floodlights 17 are shown mounted in various locations in the room or confined spaced separate and apart from the housing 12 of the exit sign 10. The remote floodlights 17 may be attached to walls or the ceiling using any known attachments means, including, but not limited to, threaded fasteners and other structural supports. The remote floodlights 17 may have a similar structure to that of floodlights 18 described in accordance with FIGS. 3A-3C, except for having a cylindrical stem for attachment to the housing 12. Separate batteries and charging system (not shown) may be mounted within the housing 12 of the exit sign 10 for powering the remote floodlights 17. The batteries and charging system for remote floodlights 17 may be installed within, for example, the second chamber 44 adjacent with batteries and charging systems for the attached floodlights 18. Wiring 19 runs from the batteries and charging system within the housing 12 to the remote floodlights 17.

Many various arrangements and configurations of the floodlights are possible in accordance with one or more embodiments disclosed herein. For example, in a first arrangement, the exit sign 10 may include two floodlights 18 attached to the housing 12 and no remote floodlights as shown in FIGS. 1 and 2. In a second arrangement, the exit sign may include two floodlights 18 attached to the housing 12, and two remote floodlights 17 may be disposed at remote locations in a room or confined space, as shown in FIG. 4 (for a total of four floodlights). In a third arrangement, a single floodlight 18 may be attached to the housing 12 of the exit sign 10, and three remote floodlights 17 may be disposed at remote locations in the room or confined space (for a total of four floodlights). In yet a fourth arrangement, no floodlights may be attached to the housing 12 of the exit sign 10, and four remote floodlights 17 may be disposed at remote locations in the room or confined space (for a total of four floodlights). Yet other floodlight arrangements are possible, such as one attached floodlight 18 and one remote floodlight 17, and one attached floodlight 18 and two remote floodlights 17. Still further, in certain embodiments, the exit sign 10 may be without a sign panel 16 and include only one or more floodlights, either attached or remotely located.

The Abstract of the disclosure is written solely for providing the United States Patent and Trademark Office and the public at large with a means by which to determine quickly from a cursory inspection the nature and gist of the technical disclosure, and it represents solely a preferred embodiment and is not indicative of the nature of the invention as a whole.

While the preferred embodiment of the invention has been illustrated in detail, the invention is not limited to the embodiment shown. For example, although the preferred embodiment described is an explosion-proof LED edge-lit exit sign, other non-incandescent light sources and illumination techniques, such as the use of a sign box or fiber optics, are within the scope of the invention. Additionally, the scope of the invention includes other illuminated signs and placards for use in hazardous areas and is not limited to exit signs or other emergency fixtures. For example, the illuminated sign according to the invention may be used to indicate the location of an eyewash station or an isle number. It is apparent that modifications and adaptations of the above embodiment may occur to those skilled in the art. Such modifications and adaptations are in the spirit and scope of the invention as set forth herein:

What is claimed:

1. An exit sign (10) comprising:

an explosion-proof housing (12), said housing comprising a first chamber (44) and a second chamber (46) within the housing separated by a divider wall (46);

a front cover (14) attached to said housing and defining an interface between said housing and said front cover, said interface defining a vent path for gases within said housing to exit said housing, and said front cover and said housing defining a heat sink for cooling said gases exiting said housing through said vent path;

a bottom plate (34) attached to said housing and defining an interface between said housing and said bottom plate, said interface defining a vent path for gases within said housing to exit said housing, and said bottom plate and said housing defining a heat sink for cooling said gases exiting said housing through said vent path;

a window (35), disposed in said bottom plate, containing a clear glass or plastic window pane (37) and located proximate to said first chamber of said housing, wherein a volume of said first chamber, a housing wall thickness surrounding said first chamber, a divider wall thickness, and a window pane thickness are arranged and designed according town expected internal explosion pressure within said first chamber;

wherein a volume of said second chamber, a housing wall thickness surrounding said second chamber, and a divider wall thickness are arranged and designed according to an expected internal explosion pressure within said second chamber;

a generally planar sign panel (16) having a first edge which is coupled to said housing at said window;

an indicium (22) disposed on said sign panel;

a plurality of light emitting diodes (32) disposed within said second chamber of said housing and directed to shine light through said window into said sign panel; and at least one floodlight (17, 18) comprising one or more light emitting diodes (60) directed to illuminate a region in proximity with said exit sign.

2. The exit sign of claim 1, said floodlight (17, 18) comprising:

a bowl-shaped light fixture (62) on which said one or more light emitting diodes (60) are disposed, said light fixture disposed within an explosion-proof housing (52); and a socket (70) having a bowl-like depression, and disposed within said housing, said bowl-shaped light fixture arranged and designed to correspond with the bowl-like depression of said socket, wherein said bowl-shaped light fixture is adjustable and moves relative to said socket to adjust a direction of lighting from said one or more light emitting diodes.

3. The exit sign of claim 2, said floodlight (17, 18) further comprising a hollow screw (72) extending from said bowl-shaped light fixture through a groove (68) formed in said socket.

4. The exit sign of claim 1, further comprising one or more rechargeable batteries disposed within said housing (12) and operatively coupled to said one or more light emitting diodes (60) of the floodlight (17, 18).

5. The exit sign of claim 1, further comprising a rechargeable battery (25) disposed within said housing (12) and operatively coupled to said one or more light emitting diodes (32) directed to shine light through said window and into said sign panel.

6. The exit sign of claim 1, wherein said floodlight (18) is attached to said housing by way of a cylindrical stem (54) having a swivel (56), wherein said swivel is arranged and designed to allow said floodlight to rotate 360 degrees.

7. The exit sign of claim 1, said floodlight (17, 18) further comprising a light cover (64) of a transparent or translucent material through which light from said light emitting diodes shines.

8. The exit sign of claim 1, wherein said floodlight (17) is remotely located from said housing of said exit sign.

9. The exit sign of claim 1, wherein an expected internal explosion pressure within said first chamber is between approximately 200 psi and 700 psi.

10. The exit sign of claim 1, wherein an expected internal explosion pressure within said second chamber is between approximately 400 psi and 900 psi.

11. An exit sign (10) comprising:

an explosion-proof housing (12), said housing comprising a first chamber (44) and a second chamber (46) within the housing separated by a divider wall (46);

a front cover (14) attached to said housing and defining an interface between said housing and said front cover, said interface defining a vent path for gases within said housing to exit said housing, and said front cover and said housing defining a heat sink for cooling said gases exiting said housing through said vent path;

a bottom plate (34) attached to said housing and defining an interface between said housing and said bottom plate, said interface defining a vent path for gases within said housing to exit said housing, and said bottom plate and said housing defining a heat sink for cooling said gases exiting said housing through said vent path;

a window (35) disposed in said bottom plate containing a clear glass or plastic window pane (37) and located proximate to said first chamber of said housing;

a generally planar sign panel (16) having a first edge which is coupled to said housing at said window;

an indicium (22) disposed on said sign panel;

a plurality of light emitting diodes (32) disposed within said second chamber of said housing and directed to shine light through said window into said sign panel;

at least one floodlight (17,18) arranged and designed to illuminate an area, said floodlight comprising:

a light source (60) disposed on a bowl-shaped light fixture (62), said light fixture disposed within an explosion-proof housing (52); and a socket (70) having a bowl-like depression, and disposed within said housing, said bowl-shaped light fixture arranged and designed to correspond with a bowl-like depression of said socket, wherein said bowl-shaped light fixture is adjustable and moves relative to said socket to adjust a direction of lighting from said one or more light emitting diodes;

one or more rechargeable batteries disposed within said housing and operatively coupled to said light emitting diodes (32) and (60).

12. The exit sign of claim 11, wherein said floodlight (18) is coupled to said housing by a stem (54) comprising a swivel (56), wherein said swivel is arranged and designed to allow said floodlight to rotate 360 degrees.

13. The exit sign of claim 11, wherein a volume of said first chamber, a housing wall thickness surrounding said first chamber, a divider wall thickness, and a window pane thickness are arranged and designed according to an expected internal explosion pressure within said first chamber.

14. The exit sign of claim 13, wherein an expected internal explosion pressure within said first chamber is between approximately 200 psi and 700 psi.

15. The exit sign of claim 11, wherein a volume of said second chamber, a housing wall thickness surrounding said second chamber, and a divider wall thickness are arranged and designed according to an expected internal explosion pressure within said second chamber.

16. The exit sign of claim 15, wherein an expected internal explosion pressure within said second chamber is between approximately 400 psi and 900 psi.

17. The exit sign of claim 11, said floodlight (17,18) further comprising a hollow screw (72) extending from said light fixture through a groove (68) formed in said socket.

18. The exit sign of claim 11, said floodlight (17,18) further comprising a light cover (64) of a transparent or translucent material through which light from said light emitting diodes shines.

19. The exit sign of claim 11, wherein said floodlight (17) is remotely located from said housing of said exit sign.

* * * * *